US010433667B2

(12) United States Patent
Alcantara Talavera

(10) Patent No.: US 10,433,667 B2
(45) Date of Patent: Oct. 8, 2019

(54) DEVICE AND METHOD FOR THE DUAL CONTROL OF MECHANISMS OF EITHER DRAPES OR CURTAINS

(71) Applicant: Magno Alcantara Talavera, Mexico City (MX)

(72) Inventor: Magno Alcantara Talavera, Mexico City (MX)

( * ) Notice: Subject to any disclaimer, the term of this patent is extended or adjusted under 35 U.S.C. 154(b) by 199 days.

(21) Appl. No.: 14/917,770

(22) PCT Filed: Jun. 11, 2015

(86) PCT No.: PCT/MX2015/000096
§ 371 (c)(1),
(2) Date: Mar. 9, 2016

(87) PCT Pub. No.: WO2016/064262
PCT Pub. Date: Apr. 28, 2016

(65) Prior Publication Data

US 2017/0280910 A1 Oct. 5, 2017

(30) Foreign Application Priority Data

Oct. 20, 2014 (MX) ..... MX/a/2014/012670

(51) Int. Cl.
*A47H 5/02* (2006.01)
*A47H 5/032* (2006.01)
*E06B 9/68* (2006.01)

(52) U.S. Cl.
CPC ..... *A47H 5/02* (2013.01); *A47H 5/032* (2013.01); *E06B 9/68* (2013.01)

(58) Field of Classification Search
CPC ..... A47H 5/02
USPC ..... 318/430, 34
See application file for complete search history.

(56) References Cited

U.S. PATENT DOCUMENTS 6,100,659 A * 8/2000 Will ..... E06B 9/174 160/1
8,786,236 B2 * 7/2014 Zaharchuk ..... E05F 17/00 160/1
2014/0290870 A1 10/2014 Colson et al.

FOREIGN PATENT DOCUMENTS

BE 1016471 A6 11/2006
ES 276428 U 5/1984

* cited by examiner

*Primary Examiner* — David Luo

(57) ABSTRACT

A device that includes a drive roller, in which the cord for the manual control of a mechanism for opening and closing a curtain or blind is partially wound to allow that said mechanism of curtain or blinds can be automated while maintaining the manual control at the same time.

18 Claims, 7 Drawing Sheets

DEVICE AND METHOD FOR THE DUAL CONTROL OF MECHANISMS OF EITHER DRAPES OR CURTAINS

FIELD OF THE INVENTION

The current invention is an electronic and mechanical device which includes elements to control the mechanism for opening and closing of curtains and/or blinds, wherein said curtains and/or blinds are able to be controlled in a dual way, either manual or automated in only one device. Also, methods of operation are provided.

BACKGROUND OF THE INVENTION

In the art, there are different types of curtains and blinds that are normally opened and closed by manual means. Depending on the type of them, a mechanism that provides control that makes these curtains or blinds open and close will be designed. In the art, either a roller bearing mechanism is typically used when the curtain vertically opens, or more complex mechanisms when the curtains/blinds open horizontally. In most of these mechanisms a cord, chain or rope, which is pulled from one of its sides to generate the torque which generates a rotational movement for opening or closing the curtain or blind, is used.

Furthermore, there are automated mechanisms that are able to include a curtain and/or drape so that opening/closing is performed automatically or automated, either by a remote control in communication with the automated mechanism, by a light and/or motion, temperature, time etc., sensor. Normally, once a drape is automated, it cannot be opened or closed manually as the automated mechanism is designed to be controlled only by electronic means, the mechanism is rigid to the manual movement and lacks a cord, that is, the movement of the curtain or drape is only generated by the corresponding electronic impulse in said automated mechanism. Considering the complexity of these automated mechanisms, these are designed together with the type of curtain since its origin taking into account the application, the measures of the window or door to be covered, curtain weight, complexity of installation, user's taste, aesthetics, friction generated by the mechanism, curvature caused by the weight of the mechanism and curtain themselves, electric power needed, etc., in order to obtain a final product that was designed particularly in its entirety, and that is installed in the house or corresponding user's place. All these considerations, as well as increasing the time of design and installation, significantly raise the final price for the user leaving the industry of automated curtains and blinds only for people with relatively high resources, that is, for a very small sector. In special cases wherein an automatic curtain is required, such as hospitals, homes for people with limited mobility, etc., a problem for the user is generated.

It is necessary to provide a device able to control, automatically or automated, the mechanism of a drape or curtain known in the art avoiding tailored designs, also wherein the manual control of the curtain is maintained, that is, a dual control. It is also necessary to provide methods of operation for said dual control (automatic/automated and manual) of said blind or curtain.

The present invention provides a device that can be installed in virtually any curtain or drape in the market in order to automate said blind or curtain in a dual way, without the need of a complex design for each individual home. Additionally, methods of operation for this device are provided, which can be applied in other situations. Therefore, it can be used anywhere in the world and also matching the needs of disabled people without having to rely on third party programmable-devices.

SUMMARY OF THE INVENTION

The current invention is a device comprised of a drive roller with different diameters, an electric motor, a microcontroller capable of communication with a control stage for controlling said electric motor, a plurality of sensors compatible with the inputs and outputs of the microcontroller, a housing for placing, at least partially, the electronics and PCB cards, passive elements, active elements, etc., and a power supply.

The drive roller is defined by sections of different diameters along its length, wherein the drive roller is coupled to the electric motor, so that the electric motor has the power and torque required to rotate the guide roller in both directions, along with the resistive force implied in the movement of the mechanism of the curtain or drape. Said motor is controlled by a microcontroller or any other programmable element capable of communicating with external devices, as well as digital/analog inputs and outputs to interact with the environment/user.

The shape of the drive roller allows to be coupled to a cord, chain or rope which permits the manual rotation of the curtain or blind, wherein the coupling, being performed by partial winding, takes place at any height within the range of movement of said cord.

The drive roller, within its length, has several sections with smaller diameters and several with larger diameter, wherein the larger diameter sections are at the distal ends of the length of the drive roller to ensure the linearity of the movement, as well as within the length of the drive roller to separate the ends of the cord. The ends of the cord are wound in different sections of the drive roller which are located between the larger diameter sections.

An end of the cord is partially wound on one of the smaller diameters of the drive roller ensuring the original direction of movement of the cord. The other end of the cord is partially wound on another small diameter of the drive roller. To prevent the cord from slipping, an external layer of a special material is added to the drive roller, such as an adhesive layer or rubber, silicone, rough textured surface or any surface that increases the friction according to the material that is made the cord, rope or chain. Also, the diameters of the drive roller can be varied to match the movement of the curtain mechanism wherein it is coupled.

In one embodiment, the electric motor allows free movement of the shaft when it is not energized, in such a way that the manual movement of the curtain together with the automated motion is maintained. Also, by coupling a detector of the current induced by the movement of the motor, it is possible to detect the current generated by the motor, which is representing manual movement of the cord.

In one embodiment, the electric motor does not allow movement when it is not energized.

In order to identify the direction in which the cord is pulled, said detector of the current induced by the motor is utilized, which once it is manually rotated, generates a current in a particular direction, wherein it can be measured and identified. In this regard, it is possible to identify the direction of the cord being pulled utilizing push-button switches on each end of the cord attached to a fixed part as the housing of the motor and coupled so that when the pull of the cord is generated, they are activated. A switch for either each direction of the cord. The housing covers and holds, at least partially, every element of the device.

In order to automatically stop the movement of the motor, as is customary in the art, a pin is placed in a predefined location of the cord. Said pin has a larger diameter than the cord so that, during movement of the cord, the pin activates a switch. Also, in an embodiment of the invention, in order to stop the movement of the motor, stopping elements are used such as sensors or magnetic detectors already known in the art, wherein an element of this sensor is placed on the cord to a location previously set, that is, in a location that permits opening and/or closing the blind completely and, while the cord is moving, said element gets to be closer to the other element of the magnetic sensor, which is attached to a fixed part of the motor housing so that, once both elements are located to each other at a distance with corresponding magnetic range, the magnetic switch located in the fixed element of the magnetic sensor, which is in communication with the microcontroller is activated so that the motor is stopped.

As it is known in the art, the microcontroller can be compatible with different types of sensors so that, based on a previous configuration, said microcontroller activates or deactivates the motor based on the readings from the sensors coupled thereto. Similarly, the microcontroller, and thus the device of the present invention may be coupled to a compatible system. Additionally, a transceiver is coupled to the microcontroller, to allow control of the device of the present invention through one or more methods already known in the art such as remote control by different methods also well known in the art.

It is noteworthy that the methods and devices disclosed herein can have other applications than described.

DETAILED DESCRIPTION OF THE INVENTION

The term drape or curtain is not intended to limit the scope of the present invention, since the invention is applicable in both objects, whether drape or curtain in conjunction with the entire mechanism that controls it, as well as equivalent objects or where the present invention can be applied, either through their devices and/or methods described.

Curtains and/or drapes are made of materials, weight, application, etc. which may vary without affecting the scope of the present application, since the elements comprising the present invention may also vary in their characteristics so as to correspond to the mechanism controlling said curtain, blinds or equivalent. The materials can be selected from different types of fabrics, to different types of metals, including polymers as well.

Likewise, the term cord refers to the rope, chain, cable, etc. which it is used in the art to be pulled and thus rotate a mechanism that opens or closes a curtain, blind or equivalent.

Figure 1:
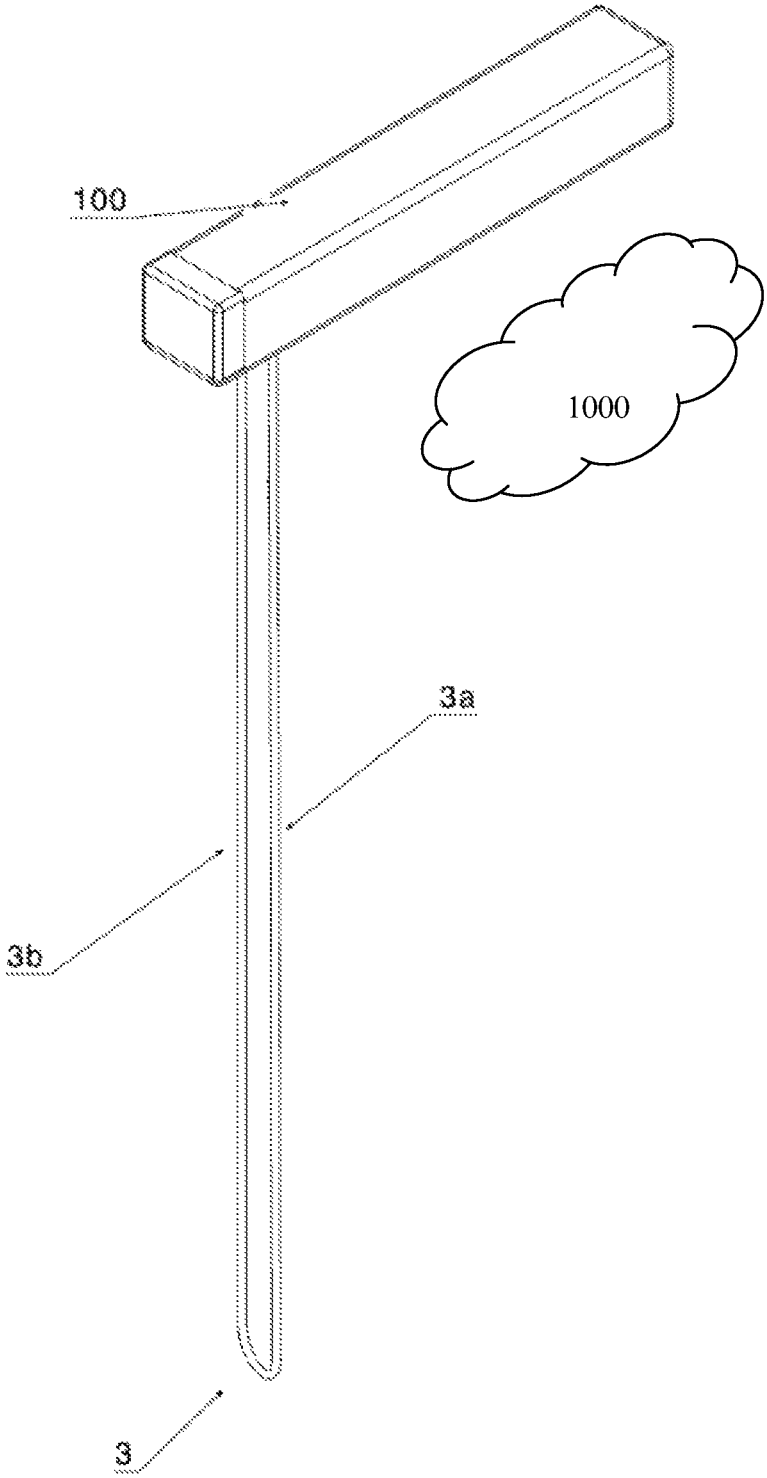
FIG. 1 shows a mechanism for manual control of blind or curtain as is customary in the art.

FIG. 1 shows an isometric view of a control mechanism 100 of curtain or blind that is located in the location 1000 already known in the art. The curtain or blind can be opened or closed either horizontally or vertically. Basically, the entire set of blind or curtain 1000 is comprised of a mechanism 100 which is activated by a rotary movement; and a cord 3, which is pulled, either from its end 3*a* or 3*b* to rotate the mechanism 100 and thereby open or close the blind. In such a way that, for example, if it is pulled from the end 3*a*, the blind is gradually closed according to the pulling of said end 3*a* to reach a final point or limit wherein the blind is completely closed and the cord is not able to be pulled anymore, since normally a blocking element is used to limit the movement at that point. The pulling is made from a location close to the control mechanism towards a distant location to the control mechanism. Similarly, if the cord is pulled in the opposite direction, that is, pulled from the end 3*b*, the blind gradually opens according to the pulling of the cord in said direction. It is important to mention that there are blinds in the art that once they are pulled, either from the end 3*a* or the end 3*b*, to the limit, they will be completely either closed or opened in both limits, and its point of maximum opening or closing is located at a midpoint between the limit of the pulling from 3*a* and the limit of the pulling from 3*b*. The present invention is also applicable to such mechanisms.

Figure 2:
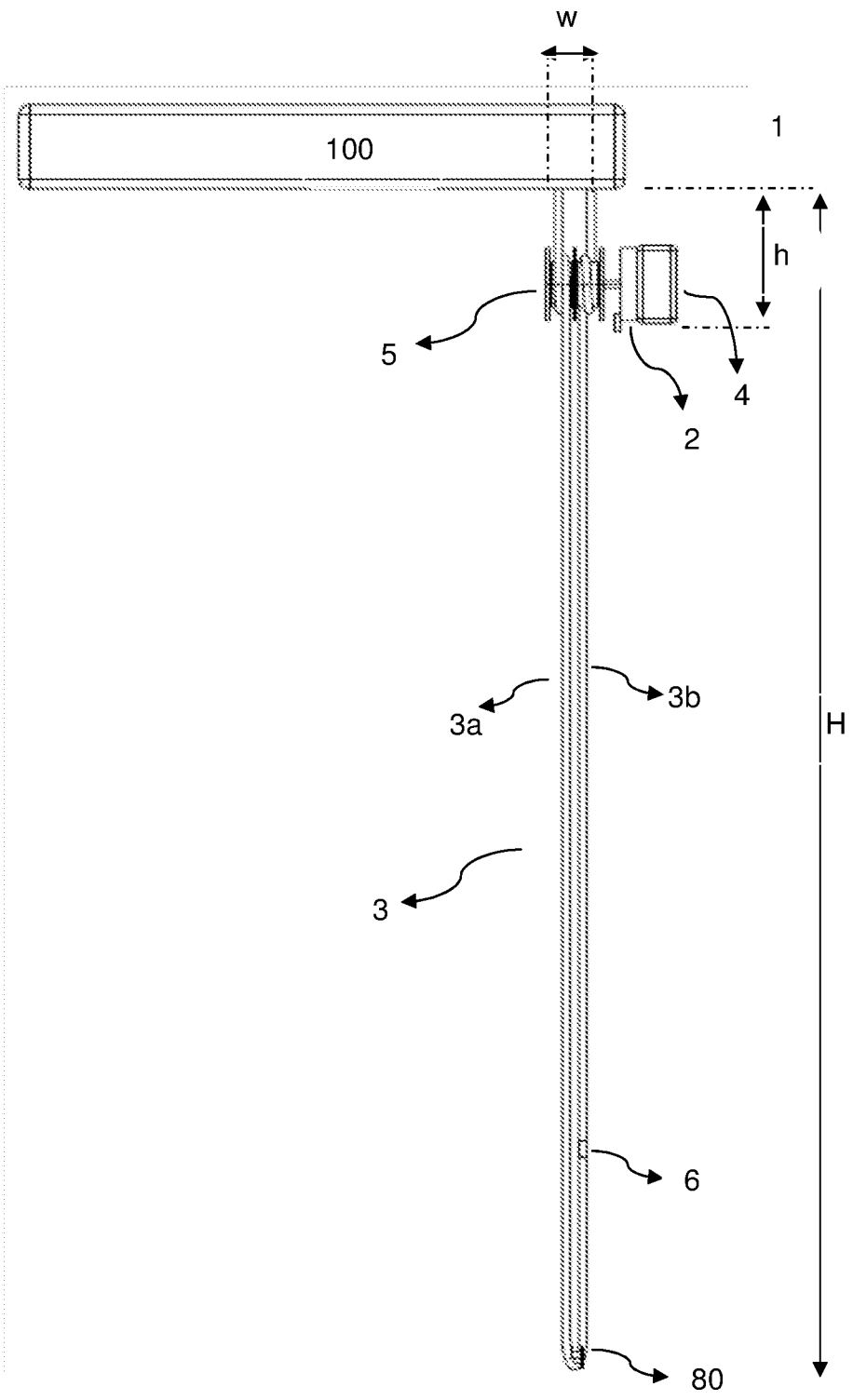
FIG. 2 shows a side view of the device of the present invention engaged in the mechanism of FIG. 1
Figure 3:
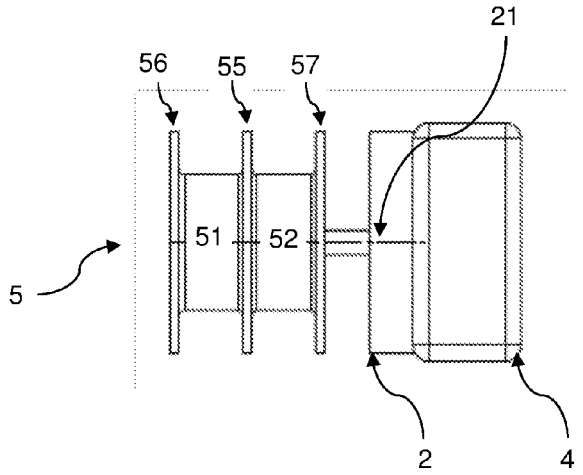
FIG. 3 shows a side view of the drive roller

FIG. 2 shows a side view of the present invention 1 coupled in the curtain mechanism of FIG. 1, wherein the device 1, using the drive roller 5, is coupled to the cord 3. As shown in FIG. 3 the drive roller 5 is comprised of a plurality of sections with different diameters 51, 52, 55, 56 and 57, which are coupled concentrically around a shaft 21 to form said drive roller 5. The distance of separation between the sections with large diameter is greater than the thickness of the cord 3. Again in FIG. 2, for coupling the cord 3 to device 1, a part of the end 3*a* is partially wound on a small diameter 51 of the drive roller 5 and a part of the cord of the end 3*b* is wound on the small diameter 52 of the drive roller 5. One skilled in the art will note that in the smaller diameter section either 51 or 52 can be wound on the either the end 3*a* or 3*b* or vice versa without affecting the object of the present invention. The winding direction of the end 3*a* and the end 3*b* in the small diameters 51 and 52 respectively is opposite and maintain the natural movement of the cord to rotate the mechanism 100. Additionally, the number of times that the cord on its ends 3*a* and 3*b* is wound around the drive roller on their diameters 51 and 52 may vary.

Once the cord 3 is coupled to the device 1, by rotating the drive roller 5, through the motor 2 and the microcontroller 4, the cord is constantly pulled thereby causing the rotational movement in the mechanism 100 and therefore the blind or curtain opens or closes depending on the direction of rotation.

Furthermore, as it is shown in FIG. 2, the device 1 of the present invention is placed at any height "h" within the length "H" of the cord without affecting the scope of the current invention. That is, the value of "h" may vary without affecting the scope of the present invention, so that this capability allows the design of an automated system of a curtain or blind maintaining an aesthetic.

In one embodiment, a secondary roller 80 at the end of the cord 3 is placed, thus ensuring tension on the cord and facilitating the movement without skids of the cord 3 on the drive roller 5.

In the FIG. 3 a side view of the drive roller 5 is shown. In an embodiment, the surfaces of the sections where the smaller diameters 51 and 52 are located are non-skid allowing the cord to have a grip or friction so that said cord is able to rotate with the drive roller 5 together.

In a preferred embodiment the surface of the smaller diameters 51 and 52 are coated with an elastomer or vulcanized material. Similarly, in one embodiment, the surfaces of the smaller diameters 51 and 52 have an anti-skid texture.

Furthermore, in FIG. 3 the sections of the drive roller 5 wherein the diameter is greater, that will be called larger diameters 56, 55 and 57; and wherein the diameters are small 51 and 52, are shown. The larger diameters 56 and 57 are in opposite ends of the length of the roller and preferably have the same dimensions. The length of the sections may vary without affecting the scope of the present invention. In a preferred embodiment, the large diameter 55 has the same radius as the large diameters 56 and 57. The main objective of the large diameters 56-57 is to contain the cord coiled on the ends 3*a* and 3*b* around the small diameters, since during the rotation of the motor the cord can trend to go out from its position on the small diameters, so that the large diameters contain said trend. FIG. 3 shows a drive roller 5 with two smaller diameters and three larger diameters, which contain the sections 3*a* and 3*b* of the cord. However, in one embodiment the drive roller 5 has a larger amount of small and large diameters for supporting a plurality of cords, either of another blind or curtain, or the same blind or curtain, but for a different function. The thickness of the diameters may vary to prevent the wound cord leaves the rotating surface represented by the small diameters. In one embodiment, the drive roller 5 includes teeth to pull chains.

In one embodiment the large diameter and small diameter have the same dimensions.

In a preferred embodiment, the smaller diameters 51 and 52 have a diameter which is similar to the distance between the end 3*a* and the end 3*b* at their closest point to the mechanism 100, that is, the distance "w".

Figure 4:
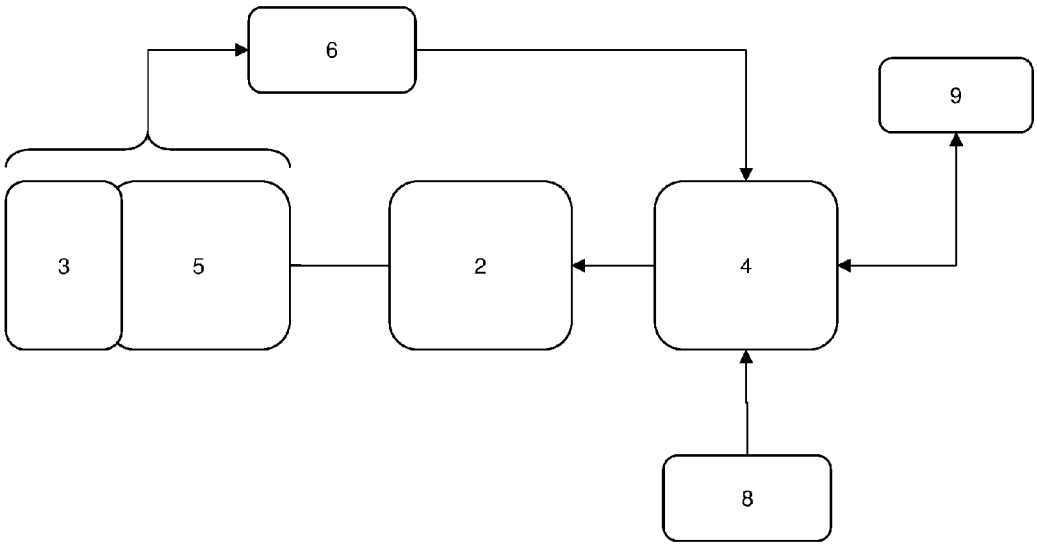
FIG. 4 shows a block diagram of the device of the present invention

FIG. 4 shows a block diagram of the device 1 of the present invention, wherein the device is comprised of a drive roller 5 coupled to a motor 2, wherein a cord 3 of a mechanism for opening and closing a blind is partially coiled around the drive roller 5; a microcontroller 4 which controls the motor, wherein the microcontroller 4 includes digital/analog inputs and outputs, as well as serial communication ports for communication with third party devices or technologies; a housing 7 (not shown in the figures), which holds the elements of the device 1 and is fixed to a structural element of the building where the mechanism 100 is placed, as a column, wall or equivalent near or where the mechanism 100 is installed; switches or sensors which detect the limits of movement, that is, means for stopping or limit detectors 6 which sends a signal to the microcontroller 4 when the blind or curtain is opened or closed at a maximum in both directions; in a preferred embodiment a transceiver 9 for sending and receiving data remotely; in one embodiment the device includes a plurality of sensors 8, in order the microcontroller to compute the signals sent by said sensors and thus operate the blind; a firmware or previous configuration in the microcontroller 4 for operating the type of blind or curtain; and common elements in any electronic device such as a power supply (not shown), interfaces, H-bridge, etc. The motor 2, allows the movement of its shaft 21 when the motor is not energized.

In one embodiment, the device 1 comprises a current detector (not shown in Figures) coupled to the motor 2 and in communication with the microcontroller 4 to thereby detect current flow when the cord 3 is pulled manually, so that the motor 2 is rotated manually and functions as a generator, which can be measured and identified by the microcontroller 4 through said detector. The direction of the sensed current defines the direction of rotation of the cord 3. In a preferred embodiment, when detecting that the cord 3 has been pulled, the device 1 starts the movement of the motor 2 in the same direction in order to cooperate with the manual movement.

The microcontroller 4, which is a programmable element, sends a signal to the motor 2 to rotate either in one direction or the other through an interface such as an H-bridge or equivalent. The microcontroller also receives inputs from different means in order to interpret, according to previous configuration or firmware, to instruct the motor to rotate. The inputs can be received from various sensors, such as light sensors, motion sensors, temperature sensors, etc. Also, besides the microcontroller 4 is able to communicate directly with third party devices or systems through a communication port known in the art by allowing communication with other programmable elements, in one embodiment, a compatible transceiver 9 is coupled to the microcontroller, which it is configured to receive data remotely, wherein the data is sent by third party devices or systems for interaction with the device 1, wherein the data is interpreted by the microcontroller 4, so that in this way one or more users will be able to control the device 1 using, for example, one or more remote controls. The transceiver can be wired or wireless, through technologies well known in the art such as radio frequency, WiFi, Bluetooth, ZigBee, X10, among others, and/or variations thereof.

By enabling both the manual control and also automation of the curtain or drape simultaneously, the device 1 allows a dual control in said drape, wherein the user can manually pull the cord or control the drape via a remote control. Wherein the remote control systems may vary without affecting the scope of the present invention. Also, the present invention can be applied to only automated control, that is, through a remote control or a control in situ, or only to allow manual control and manual control with automation of the drape, as explained above and wherein the method of operation is shown below.

Figure 5:
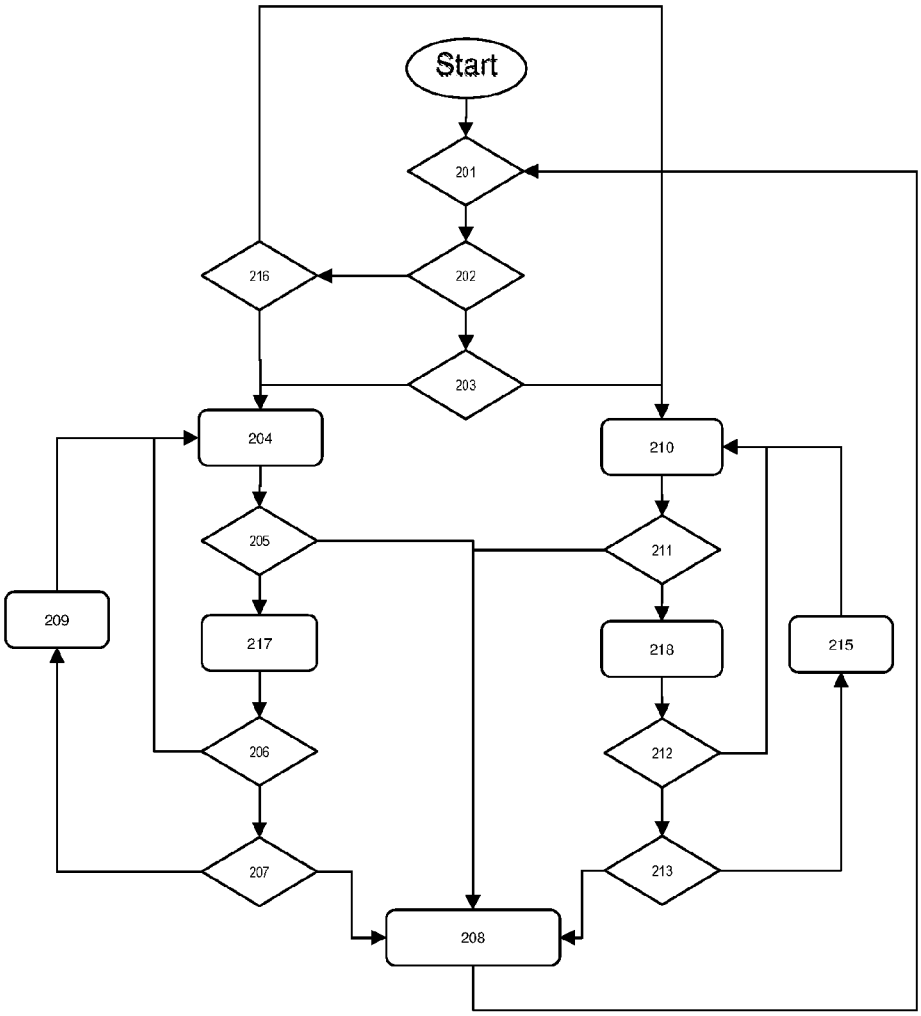
FIG. 5 shows a flowchart of the method of operation of the device of the present invention when operating in a dual way using a detector of induced current.
Figure 6:
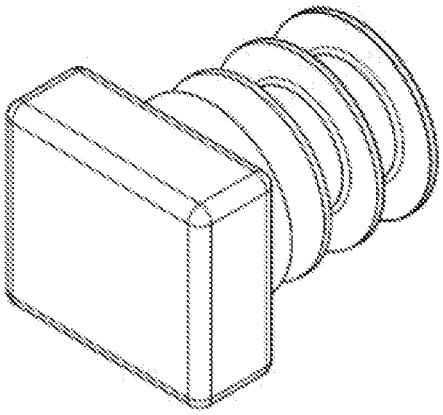
FIG. 6 shows an isometric view of the drive roller
Figure 7:
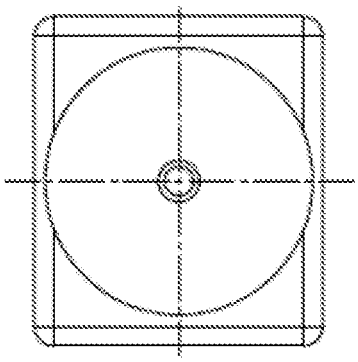
FIG. 7 shows a front view of the drive roller.
Figure 8:
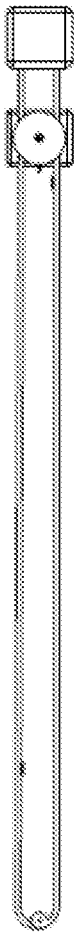
FIG. 8 shows a front view of the device of the present invention coupled to a mechanism for opening and closing the curtain or blind.
Figure 9:
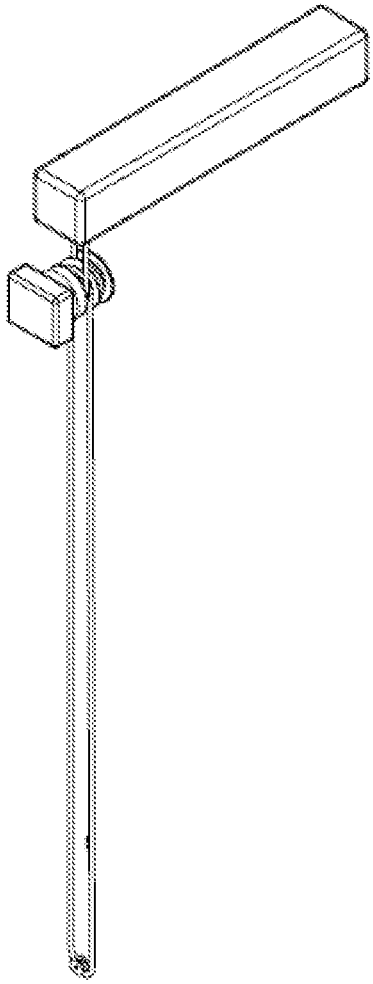
FIG. 9 shows an isometric view of the device of the present invention coupled to a mechanism for opening and closing the curtain or blind.

FIG. 5 shows a flow chart explaining the method of operation of the device 1 of the present invention when a current sensor is operationally coupled. Said current is induced by the motor 2 which, once it is rotated manually by pulling from the cord 3 acts as a generator so the induced current and its direction can be measured and identified.

In step 201 induced current is to be detected by the current sensor, so if current is detected in step 202, the device determines if the cord 3 is in one of its two limits, either limit of pulling in the end 3*a* or the end 3*b*, i.e. either in one rotational direction or in the other rotational direction. To determine if the cord 3 is in any of its limits magnetic sensors 6 or any other means known in the art are used. If in step 202 it is determined that it is not in any of its motion limits, in step 203 is determined, by the direction of the detected current, the direction of the pulling, which is comprised of two options which we call direction A (according to clockwise) and direction B (anti-clockwise). So that if the detected direction is direction A, in step 204 the microcontroller sends the order to the motor 2 to rotate by predetermined revolutions or a period of time in the same direction A, wherein in step 205 the device 1 detects whether it has reached a limit of movement during rotation of the motor 2, wherein once it is detected, in step 208 the motor 2 stops, and then return to step 201. If no limit of movement is detected, after passing the predetermined revolutions or period of time in step 204, in step 217 the motor 2 stops for a predetermined period of time and then in step 206, the device 1 detects whether a new pulling has been conducted on the cord 3, so that in step 207 detects whether the pulling has been conducted in the opposite direction to the previous direction, i.e. in the direction B, wherein in step 208 the motor is stopped or de-energized. However, if the pulling has been conducted in the same direction of the previous rotation, i.e. the direction A, in step 209 the predetermined revolutions or period of time is adjusted and returns to step 204, said adjustment is either to reduce or to increase said period, depending on a previous configuration of the device 1. If at the step 206, the pulling by the user is not detected, the device returns to step 204 to rotate the motor by the predetermined time and so on defining a cycle of operation.

Complementary to the direction B, if in step 203 it is detected that the direction of pulling is in the direction B, at step 210 the microcontroller sends the order to the motor 2 to rotate for a period of time or predetermined revolutions in direction B, wherein in step 211 the device 1 detects whether a limit of movement has been reached during the rotation of the motor 2, wherein if detected, in step 208 stops or de-energizes the motor 2 for then returning to step 201. If no limit of movement is detected after passing the period of time or predetermined revolutions in step 210, in step 218 the motor 2 is stopped for a predetermined period of time and then in step 212, the device 1 detects if there has been another pulling to the cord 3, so that in step 213 it is detected whether the pulling took place in the opposite direction to the direction in which it was moving i.e. in the direction A, in step 208 the motor is stopped. However, if the detected pulling is in the same direction of the previous rotation i.e. the direction B, in step 215 the period of time or the predetermined revolutions are adjusted and then returns to step 210, the adjustment is to reduce, increase or some other setting, depending on a previous configuration. If in step 212, no pulling by the user is detected, the device returns to step 210 to rotate the motor the predetermined time and thus defining an operating cycle.

In continuation, if in the step 202 it is determined that the device 1 is in one of its two limits of movement, in step 216 it is determined whether the limit is in direction A or direction B, so that if the limit is in the direction A, at step 210 the motor 2 rotates in the direction B. If the limit is in the direction B, in step 204 the motor 2 rotates in direction A, that is, in a direction opposite to the limit detected.

FIGS. 6, 7, 8 and 9 are figures included to provide graphical reference of the invention.

It will be apparent to those skilled in the art that several modifications and variations can be made in the present invention without departing from the scope or spirit of invention. Other embodiments of the invention will be apparent to those skilled in the art from the consideration of the specification and practice of the invention described herein. It is intended that the specification and examples are considered only as exemplary, with a true scope and spirit of the invention being indicated by the attached claims.

The invention claimed is:

1. An electronic device for electrically controlling a manually rotatable mechanism for opening and closing a shutter, wherein the mechanism includes a cord comprised of two parts, the device comprises:

an electric motor that allows the rotation of its axis when not energized;

a drive roller coupled to the axis of the electric motor, wherein the drive roller includes a length and at least three sections with larger diameter within said length of drive roller thus defining three major diameter and at least two sections with smaller diameter thus defining minor diameters, and wherein the distance of separation between major diameters allows the parts of the cord to wind around the minor diameters of the roller for at least one complete revolution;

characterized in that the device is located at any point of the height of the cord, and characterized in that one part of the cord is at least partially wound, in a first direction, around a minor diameter and the other part of the cord is at least partially wound, in a direction inverse to the first direction, around the other minor diameter.

2. The device according to claim 1, wherein one major diameter is located at each distal end of the length of the drive roller, and the third major diameter is located at the center of said length of drive roller.

3. The device according to claim 2, wherein the distance of separation between major diameters is larger than the thickness of the cord.

4. The device according to claim 1, wherein a current detector for detecting the current induced by the motor is coupled to said motor, wherein the current detector detects the direction and amount of current generated by the rotation of the motor when it is not energized.

5. The device according to claim 1, wherein the device further includes a second roller with free rotary movement at the end of the cord and providing tension to the cord.

6. The device according to claim 1, wherein the drive roller includes a top layer of anti-slip material.

7. The device according to claim 1, wherein the top layer of the drive roller includes an elastomeric material.

8. The device according to claim 1, wherein the top layer of the drive roller includes teeth for pulling chains or bands.

9. The device according to claim 1, wherein the diameter of the minor diameters is substantially equal to the distance of separation between the two parts of the cord.

10. A method for electrically controlling a manually rotatable mechanism for opening and closing a shutter, wherein the mechanism includes a cord, the method comprising the steps of:

in a device, which includes an electric motor that allows the rotation of its axis when not energized and a drive roller coupled to the axis of the electric motor, wherein the drive roller includes a length and at least three sections with larger diameter within said length of drive roller thus defining three major diameter and at least two sections with smaller diameter thus defining minor diameters, and wherein the distance of separation between major diameters allows the parts of the cord to wind around the minor diameters of the roller for at least one complete revolution:

determining, through a current detector, whether the shaft of the electric motor has been manually rotated;

determining, through the current detector, the direction of rotation, thus defining an initial direction of rotation;

energizing the motor in order to rotate in the same direction as the initial direction for a pre-determined period of time; and determining, through the current detector, if the motor shaft has been manually rotated again.

11. The method according to claim 10, wherein the method further includes the step of energizing the motor in order to rotate according to the initial direction until a limit is detected, when the shaft of the electric motor has not been manually rotated.

12. The method according to claim 11, wherein energizing the motor is performed at a pre-established period of time.

13. The method according to claim 12, wherein the method further includes the step of determining whether the motor shaft has been manually rotated between each period of time.

14. The method according to claim 12, wherein the period of time change upon determining that the motor shaft has been manually rotated in the same direction as the rotating direction.

15. The method according to claim 10, wherein the method further includes the step of stopping the motor when the motor shaft has been manually rotated in an inverse direction to the initial direction.

16. The method according to claim 10, wherein the method further includes the step of determining if a limit has been reached during the motor rotation.

17. The method according to claim 10, wherein the method further includes the step of determining if a limit has been reached before the step of determining whether the motor shaft has been manually rotated.

18. The method according to claim 10, wherein the method further includes the step of energizing the motor in order to rotate in the opposite direction to the initial direction upon determining that the limit has been reached.

* * * * *